US006680588B2

(12) United States Patent
Park et al.

(10) Patent No.: US 6,680,588 B2
(45) Date of Patent: Jan. 20, 2004

(54) LOW NOISE BACKLIGHT SYSTEM FOR USE IN DISPLAY DEVICE AND METHOD FOR DRIVING THE SAME

(75) Inventors: Jung Kook Park, Kyoungki-do (KR); Yeong Koo Kim, Seoul (KR)

(73) Assignee: Boe-Hydis Technology Co., Ltd., Kyoungki-do (KR)

( * ) Notice: Subject to any disclaimer, the term of this patent is extended or adjusted under 35 U.S.C. 154(b) by 0 days.

(21) Appl. No.: 10/331,996

(22) Filed: Dec. 30, 2002

(65) Prior Publication Data

US 2003/0178951 A1 Sep. 25, 2003

(30) Foreign Application Priority Data

Mar. 20, 2002 (KR) ..... 10-2002-14952

(51) Int. Cl.[7] ..... H05B 37/00

(52) U.S. Cl. ..... 315/312; 315/325; 315/224; 315/291; 315/307

(58) Field of Search ..... 315/312, 313, 315/325, 362, 291, 297, 307, 308, 224

(56) References Cited

U.S. PATENT DOCUMENTS

| | | | | |
|---|---|---|---|---|
| 5,182,650 | A | 1/1993 | Inoue et al. | 358/296 |
| 5,315,397 | A | 5/1994 | Inoue et al. | 358/296 |
| 5,528,376 | A | 6/1996 | Inoue et al. | 358/296 |
| 5,675,437 | A | 10/1997 | Hart et al. | 359/566 |
| 5,821,818 | A | 10/1998 | Idei et al. | 331/17 |
| 5,940,185 | A | 8/1999 | Inoue et al. | 358/296 |
| 5,953,002 | A | 9/1999 | Hirai et al. | 345/204 |
| 6,085,576 | A | 7/2000 | Sunshine et al. | 73/29.01 |
| 6,114,814 | A * | 9/2000 | Shannon et al. | 315/219 |
| 6,234,006 | B1 | 5/2001 | Sunshine et al. | 73/29.01 |
| 6,259,490 | B1 | 7/2001 | Colgan et al. | 349/12 |
| 6,420,839 | B1 * | 7/2002 | Chiang et al. | 315/311 |
| 2003/0025462 | A1 * | 2/2003 | Weindorf | 315/291 |

* cited by examiner

*Primary Examiner*—Haissa Philogene
(74) *Attorney, Agent, or Firm*—Ladas & Parry

(57) ABSTRACT

Disclosed is a backlight system and a method for driving backlight capable of reducing noises and voltage fluctuations in power voltage due to a turn-on/turn-off of the lamp. The backlight system includes two lamps, a power supply unit for supplying alternating voltage or alternating current supplies power for driving the lamps to each lamp with a predetermined time lag or phase difference. With this feature of the present invention, the magnitude of noise and voltage fluctuations occurring in the power voltages supplied to the power supply unit may be significantly reduced. Thus, deterioration of display quality, flicker, etc., due to noise and voltage fluctuation can be prevented. Also, there is provided a backlight system which may produce a lamp driving signal with a constant frequency obtained by multiplying a frequency of vertical synchronization signal by an integer. With this feature of the present invention, a horizontal wave or a flicker can be easily eliminated by producing the lamp driving signal synchronized with the vertical synchronization signal and operation of the lamp can be stabilized as well because the lamp is driven by the lamp driving power with a constant frequency.

10 Claims, 5 Drawing Sheets

LOW NOISE BACKLIGHT SYSTEM FOR USE IN DISPLAY DEVICE AND METHOD FOR DRIVING THE SAME

BACKGROUND OF THE INVENTION

1. Field of the invention

The present invention relates to a backlight system and a driving method for the same, and more particularly to a low-noise back light system for use in TFT (thin film transistor) LCD device and a driving method for the same.

2. Description of the Prior Art

As generally known in the art, a fluorescent lamp is used for many applications in which light is needed, but power for generating the light is limited. Such applications include a backlight system for use in a flat panel computer display. One of special types of the fluorescent lamp is a cold cathode fluorescent lamp (CCFL). A CCFL tube generally contains argon gas, Xenon gas, etc., together with a small amount of mercury. After an initial spark and a generation of plasma, alternating current flows through the CCFL tube and then ultra-violet rays are generated. Ultra violet rays radiate onto a fluorescent layer coated on an inner wall of the tube, thereby creating visible lights.

A CCFL inverter serves to receive direct current voltage from an outer power source and to supply alternating current to the CCFL tube, thus making the CCFL tube illuminated. As the modes for modulating brightness of the CCFL tube, a conventional CCFL inverter includes a pulse width modulation dimming mode and an analogue dimming mode. Of these two modes, the pulse width modulation dimming mode is used to generate driving current (alternately, driving voltage) by making use of PWM signal, a pulse width of which is modulated depending on a magnitude of the current flowing through the CCFL, and to supply the driving current. In contrast with the analogue dimming mode, a CCFL tube being operated in the pulse width modulation dimming mode repeats a process which comprises a turn-on with 600 to 800 volts and a turn-off. Thus, much noise and voltage fluctuation can arise in power voltages (typically 12 V) of the CCFL inverter. The noise and the voltage fluctuation can affect the whole driving circuit including an analogue unit and a logic unit, thus leading to deterioration of the display on LCD panel.

Also, in the conventional CCFL inverter, a frequency of the pulse width modulation (PWM) dimming mode has been separately designed from a vertical synchronization signal V_sync of a display device. Accordingly, upon an occurrence of interference between the PWM signal and the vertical synchronization signal, there has been a problem in that a horizontal wave rises in the LCD device. In order to solve this problem, a method for preventing the horizontal wave from being generated has been proposed, in which the inverter includes a phase locked loop circuit for synchronizing the PWM signal with the vertical synchronization signal. However, such a method has another problem in that because the phase locked loop circuit is sensitive to noises, if a number of CCFL tubes are installed, the high noise and voltage fluctuation occur in the power voltage and the CCFL tubes cannot work properly, as described above. Also, in the case that a phase locked loop circuit is employed, the lamp may be overloaded because the frequency of lamp driving power varies as the vertical synchronization signal varies among 60 Hz, 70 Hz, 75 Hz, etc.

SUMMARY OF THE INVENTION

Accordingly, the present invention has been made to solve the above-mentioned problems occurring in the prior art, and an object of the present invention is to provide a backlight system which makes it possible to reduce noises and voltage fluctuations due to the turning on and turning off of the lamp and a method for driving such a backlight.

Another object of the present invention is to provide such a backlight system which makes it possible to eliminate a horizontal wave or a flicker due to interference between the PWM signal and vertical synchronization signal and a method for driving a backlight.

Another object of the present invention is to provide a backlight system which makes it possible to drive a lamp with a constant frequency even when a vertical synchronization signal varies and a method for driving a backlight.

In order to accomplish these objects, according to the present invention, there is provided a backlight system including two lamps, in which a power supply unit for supplying the lamps with alternating voltage or alternating current supplies power for driving the lamps to each lamp with a predetermined time lag or phase difference. With this feature of the present invention, the magnitude of noise and voltage fluctuation occurring in the power voltages supplying to the power supply unit may be significantly reduced. Thus, deterioration of display quality, flicker, etc., due to noise and voltage fluctuation can be prevented. Also, there is provided a backlight system which may produce a lamp driving signal with a constant frequency obtained by multiplying a frequency of vertical synchronization signal by an integer. With this feature of the present invention, a horizontal wave or a flicker can be easily eliminated by producing the lamp driving signal synchronized with the vertical synchronization signal, and operation of the lamp can be stabilized as well because the lamp is driven by a lamp driving power with a constant frequency.

According to an aspect of the present invention, the low noise backlight system for use in a display device comprises: first and second lamps; a control unit for receiving a vertical synchronization signal of the display, producing a first control signal which has a duty cycle controlled depending upon currents flowing in the first lamp and is synchronized with the vertical synchronization signal, and producing a second control signal which has a duty cycle controlled depending upon currents flowing in the second lamp, is synchronized with the vertical synchronization signal and has a predetermined time lag with respect to the first control signal. The backlight system comprises a first power supply unit for causing the first lamp to be driven in synchronization with the first control signal and supplying the first driving voltage to the first lamp. Also, it comprises a second power supply unit for producing a second driving voltage for causing the second lamp to be driven in synchronization with the second control signal and supplying the second driving voltage to the second lamp.

The control unit comprises a first frequency multiplier for multiplying a frequency of the vertical synchronization signal by an integer to produce a first pulse width modulation frequency signal; and a signal delayer for delaying the first pulse width modulation frequency signal for a predetermined time to produce a second pulse width modulation frequency signal. Also it comprises a first current measuring unit for measuring currents flowing in the first lamp to produce a first feedback signal; and a second current measuring unit for measuring currents flowing in the second lamp to produce a second feedback signal. Also it comprises a first pulse width modulator for producing a first pulse width modulation signal which is synchronized with the first pulse width modulation frequency signal and has a duty cycle determined in accordance with the first feedback signal; a second pulse width modulator for producing a second pulse width modulation signal which is synchronized with the second pulse width modulation frequency signal and has a duty cycle determined in accordance with the second feedback signal. Further, it comprises a first control signal generator for receiving the first pulse width modulation signal, measuring the frequency thereof, and producing the first control signal with a constant frequency obtained by an integer multiplication depending on the measured frequency; and a second control signal generator for receiving the second pulse width modulation signal, measuring the frequency thereof, and producing the second control signal with a constant frequency obtained by an integer multiplication depending on the measured frequency.

The first control signal generator comprises: a first frequency detecting circuit for receiving the first pulse width modulation signal and measuring a frequency thereof; and a first frequency multiplication circuit for producing the first control signal with a constant frequency obtained by multiplying the first pulse width modulation signal by an integer depending on the measured frequency of the first pulse width modulation signal. The second control signal generator comprises a second frequency detecting circuit for receiving the second pulse width modulation signal and measuring a frequency thereof; and a second frequency multiplication circuit for producing the second control signal with a constant frequency obtained by multiplying the second pulse width modulation signal by an integer depending on the measured frequency of the second pulse width modulation signal.

The first power supply unit comprises: a first switch which is turned on by the first control signal and outputs power voltages through its output terminal; and a first transformer including a first coil connected to the output terminal of the first switch and a second coil connected to the first lamp. The second power supply unit comprises: a second switch which is turned on by the second control signal and outputs power voltages through its output terminal; and a second transformer including a first coil connected to the output terminal of the second switch and a second coil connected to the first lamp.

According to the other aspect of the present invention, a method for driving a backlight system including a first and a second lamp for use in a display device comprises steps of: receiving a vertical synchronization signal of the display device, producing a first control signal which has a duty cycle controlled depending upon currents flowing in the first lamp and is synchronized with the vertical synchronization signal, and producing a second control signal which has a duty cycle controlled depending upon currents flowing in the second lamp, is synchronized with the vertical synchronization signal and has a predetermined time lag with respect to the first control signal. Also the method comprises steps of producing a first driving voltage for causing the first lamp to be driven in synchronization with the first control signal and supplying the first driving voltage to the first lamp; and producing a second driving voltage for causing the second lamp to be driven in synchronization with the second control signal and supplying the second driving voltage to the second lamp.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
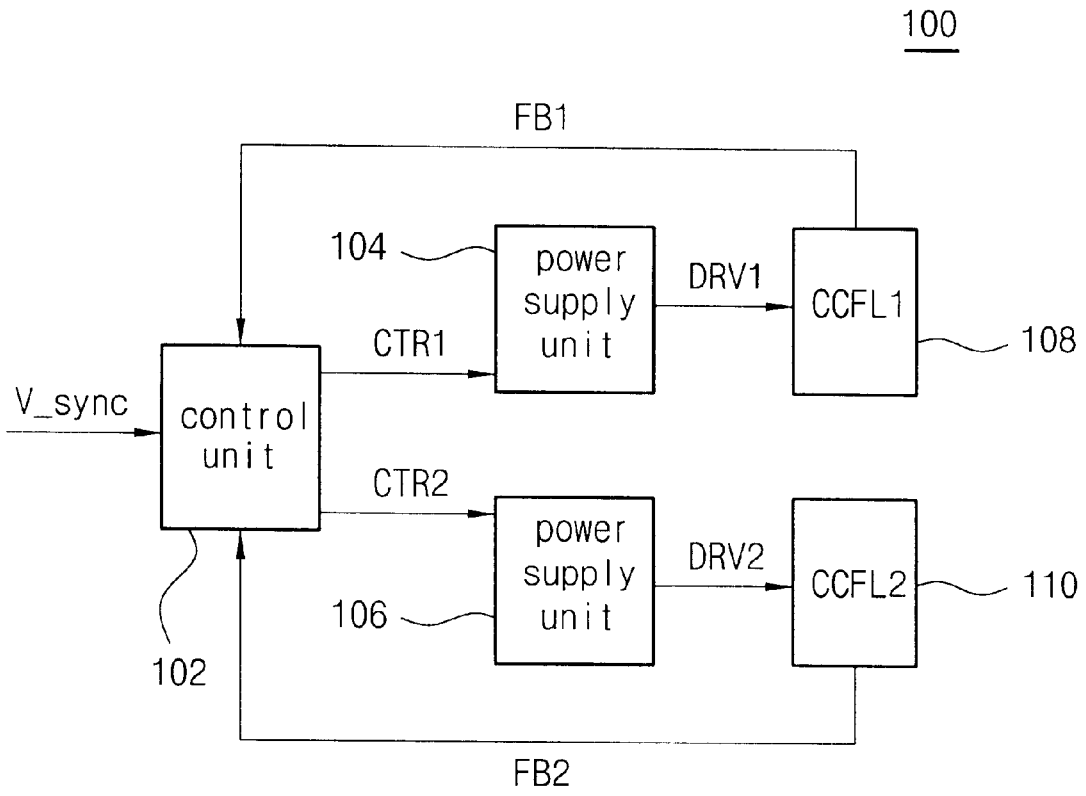
FIG. 1 is a block diagram of a backlight system according to an embodiment of the present invention.

Hereinafter, a preferred embodiment of the present invention will be described with reference to the accompanying drawings. In the following description and drawings, the same reference numerals are used to designate the same or similar components, and so repetition of the description for the same or similar components will be omitted.

FIG. 1 is a block diagram of a backlight system according to an embodiment of the present invention. As shown in FIG. 1, the backlight system 100 includes a control unit 102, a first power supply unit 104, a second power supply unit 106, and a pair of CCFL 108, 110.

In FIG. 1, the control unit 102 receives a vertical synchronization signal V_sync, a feedback signal FB1 for representing a magnitude of current flowing in the lamp 108, and a feedback signal FB2 for representing a magnitude of current flowing in the lamp 110. The control unit 102 produces and supplies to the power supply unit 104 a control signal CTR1 which has a duty cycle regulated depending on the feedback signal FB1 and which is synchronized with the vertical synchronization signal V_sync. Also, the control unit 102 produces and supplies to the power supply unit 104 a control signal CTR2 which has a duty cycle regulated depending on the feedback signal FB2 and time lag with respect to the control signal CTR1 and which is synchronized with the vertical synchronization signal V_sync. The power supply unit 104 produces a driving power DRV1 in a form of alternating voltage or alternating current for driving the lamp 108 to be synchronized with the control signal CTR1 and supplies it to the lamp 108. The power supply unit 106 produces a driving power DRV2 for driving the lamp 110 to be synchronized with the control signal CTR2 and supplies it to the lamp 110.

Figure 2:
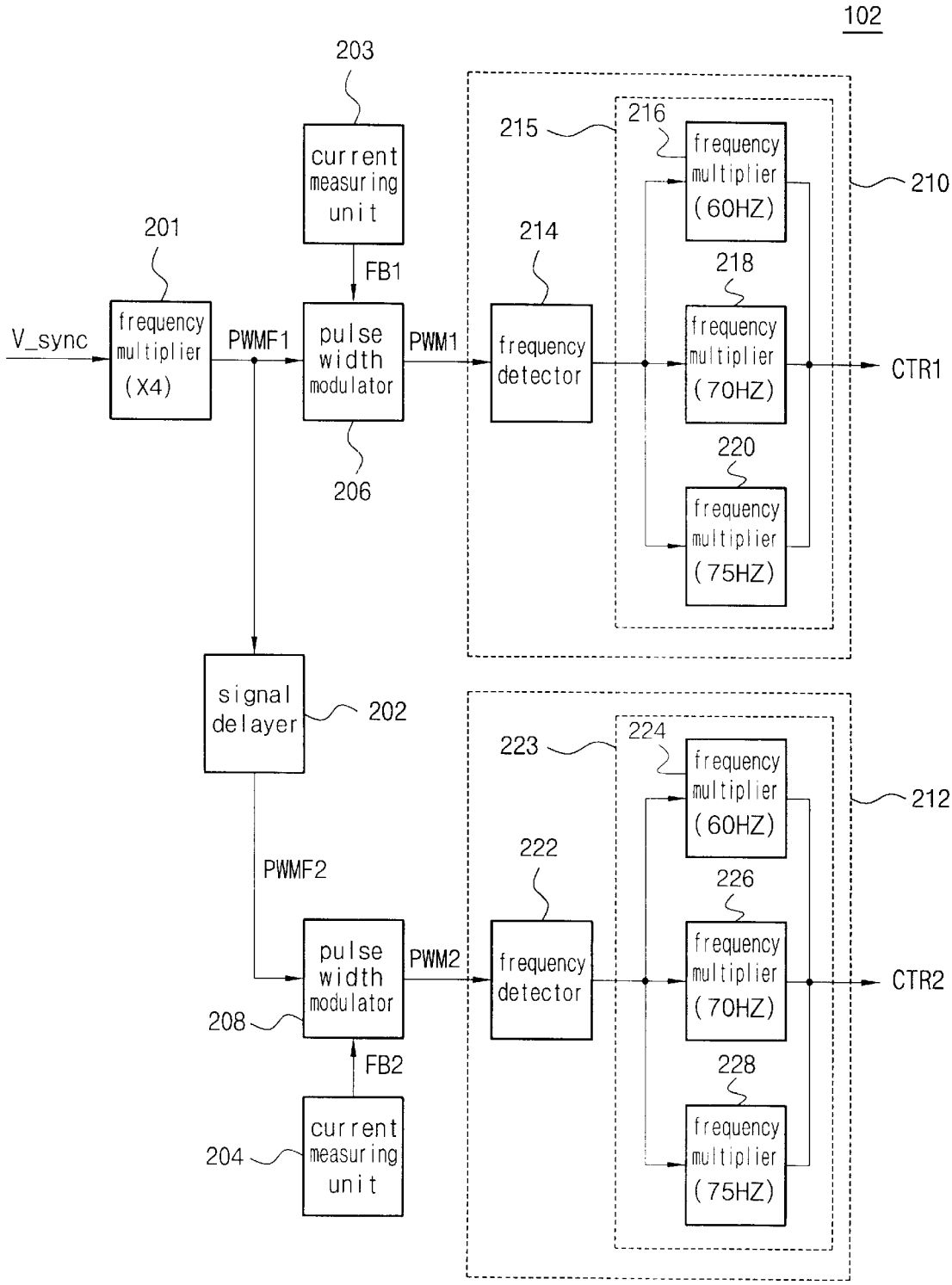
FIG. 2 is a block diagram of an example of the unit shown in FIG. 1.

FIG. 2 is a block diagram of an example of the control unit 102 shown in FIG. 1. As shown in FIG. 2, the control unit 102 includes a frequency multiplier 201, a signal delayer 202, current measuring units 203, 204, pulse width modulators 206, 208, control signal generators 210, 212. The control signal generator 210 has a frequency detector 214 and a frequency multiplying block 215, and the frequency multiplying block 215 includes three frequency multipliers 216, 218 and 220. The control signal generator 212 includes a frequency detector 222 and a frequency multiplying block 223, and the frequency multiplying block 223 includes three frequency multipliers 224, 226 and 228 in this embodiment.

In FIG. 2, the frequency multiplier 201 produces a first pulse width modulation frequency signal PWMF1 by multiplying the frequency of the vertical synchronization signal V_sync by 4. The reason why the vertical synchronization signal is multiplied by 4 in producing the pulse width modulation frequency signal PWMF1 is that the PWM signal exceeds about 90 Hz, that is, a frequency visible to a human being, and that a horizontal wave is prevented from being displayed on a display device by making the PWM signal equal to the integer multiplication of the vertical synchronization signal. Being different from the conventional way of controlling the frequency of the PWM signal by using an RC passive element outside of the CCFL control unit, the present invention has advantages in that even when the frequency of the vertical synchronization signal V_sync varies, the frequency of PWM signal can be varied accordingly, that areas for mounting parts on a printed circuit board can be saved since the passive elements are not employed, and that noise can be prevented.

The signal delayer 202 delays the first pulse width modulation frequency signal PWMF 1 for a predetermined time to produce the second pulse width modulation frequency signal PWMP. The current measuring unit 203 measures current flowing through the lamp 108 (FIG. 1) in order to produce and supply to the pulse width modulator 206 the feedback signal FB1. The current measuring unit 204 measures current flowing through the lamp 110 (FIG. 1) in order to produce and supply to the pulse width modulator 208 the feedback signal FB2. The pulse width modulator 206 produces and supplies to the control signal generator 201 the pulse width modulation signal PWM1, which has to be synchronized with the second pulse width modulation frequency signal PWMF 2 and has a duty cycle determined by the feedback signal FB1. The control signal generator 210 receives the first pulse width modulation signal PWM1 and measures the frequency thereof to produce a first control signal with a constant frequency, such as 60 KHz, obtained by an integer multiplication depending on the measured frequency. The control signal generator 212 receives the second pulse width modulation signal PWM2 and measures the frequency thereof to produce a second control signal with a constant frequency, obtained by an integer multiplication depending on the measured frequency.

As shown in FIG. 2, the control signal generator 210 includes a frequency multiplication block 215 having the frequency detector 214 and three frequency multipliers 216, 218, 220. The frequency detector receives the first pulse width modulation signal PWM1 and measures the frequency thereof. The frequency multiplication block 215 produces the first control signal CTR1 with a frequency of 60 KHz by multiplying the first pulse width modulation signal PWM1 by an integer, depending on the frequency of the first pulse width modulation signal measured from the frequency detector 214. When it is detected by the frequency detector 214 that the pulse width modulation signal PWM1 is produced by the vertical synchronization signal V_sync with a frequency of 60 KHz, the frequency multiplier 216 is activated to produce a control signal CTR1 with a frequency of 60 KHz. However, when it is detected by the frequency detector 214 that the pulse width modulation signal PWM1 is produced by the vertical synchronization signal V_sync with a frequency of 70 KHz, the frequency multiplier 218 is activated, and when it is detected that the pulse width modulation signal PWM1 is produced by the vertical synchronization signal V_sync with a frequency of 75 KHz, the frequency multiplier 220 is activated to produce a control signal CTR1 with a frequency of 60 KHz. In other words, one of three frequency multipliers 216, 218, 220 is selected depending upon the frequency of the vertical synchronization signal V_sync, in order to produce a control signal CTR1 with a constant frequency. Because the driving power for actually driving the lamp is produced by this control signal CTR 1, the lamp also has a constant frequency of 60 KHz.

The second control signal CTR2 for controlling the driving power of the lamp 110 (FIG. 1) is produced by the second control signal generator 212. As shown in FIG. 2, the second control signal generator 212 includes the frequency detector 222 for receiving the second pulse width modulation signal PWM2 and measuring a frequency thereof and the frequency multiplication block 223 for multiplying the second pulse width modulation signal PWM2 by an integer depending upon a measured frequency of the second pulse width modulation signal to produce the second control signal with a constant frequency. The frequency multiplication block 223 includes three frequency multipliers 224, 226, 228. Specific operation of the second control signal generator 212 is similar to that of the first control signal generator 210 previously described.

Figure 3:
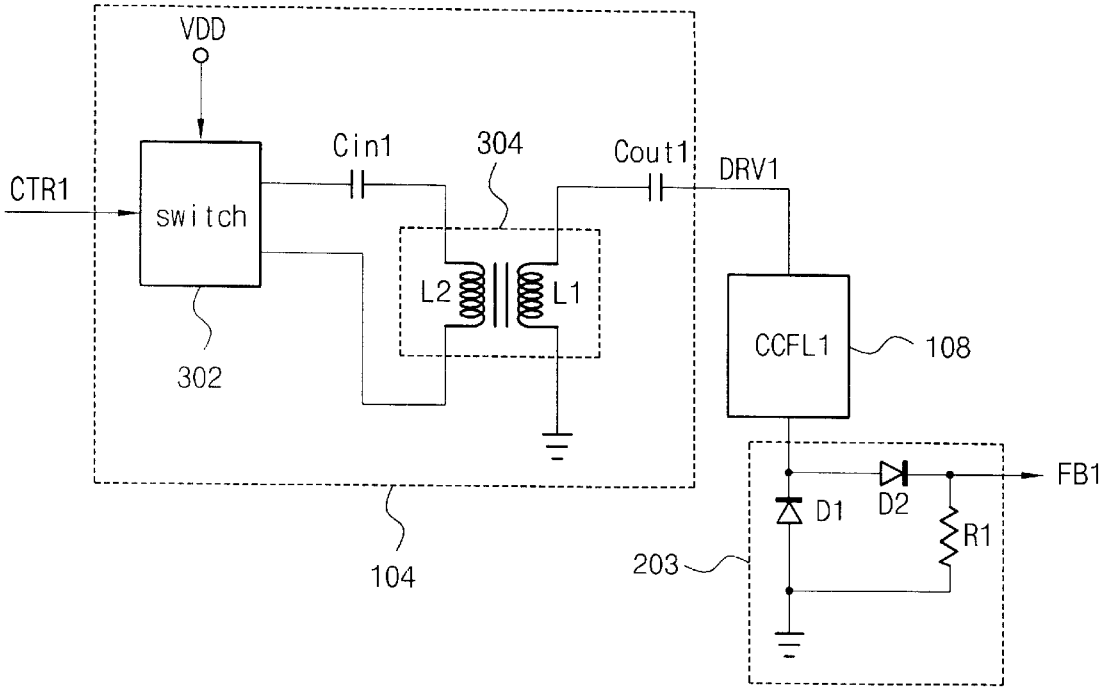
FIG. 3 is a structural diagram of an example of the first power supply unit shown in FIG. 1.

FIG. 3 is a structural diagram of an example of the first power supply unit shown in FIG. 1. As shown in FIG. 3, the power supply unit 104 includes a switch 302 and a transformer 304. The switch 302 is controlled to be turning on and turning off by the first control signal CTR1. In the case that the switch 302 is constructed with an NMOS transistor, the control signal CTR1 is turned on above a threshold voltage of the NMOS transistor to supply a power voltage VDD to a primary coil L1 of the transformer 304 through an input capacitor Cin1. Typically 12 volts are used as the power voltage VDD. A coil winding ratio between the primary coil L1 and a secondary coil L2 in the transformer is set to provide the cold cathode fluorescent lamp 108 with driving power ranging from 600 volts to 800 volts. The driving power DRV1, which is caused at the second coil L2 and outputted through an output capacitor COUT1, has the same duty cycle as the frequency of the first control signal CTR1 since the driving power DRV1 is caused by fluctuations of the first control circuit CTR1. The phase relation between the first control signal CTR1 and the driving voltage DRV1 is determined by the manner of coil winding in the transformer 304.

Figure 4:
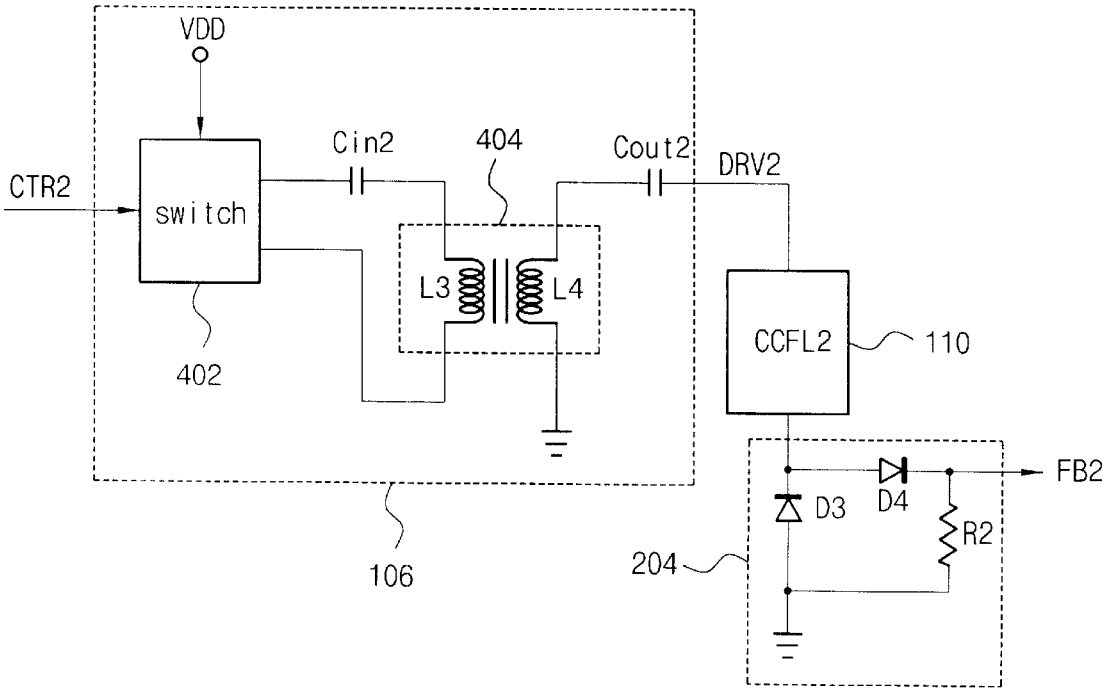
FIG. 4 is a structural diagram of an example of the second power supply unit shown in FIG. 1.

FIG. 4 is a structural diagram of an example of the second power supply unit shown in FIG. 1. As shown in FIG. 4, the power supply unit 106 includes a switch 402 and a transformer 404. The switch 402 is controlled to be turning on and turning off by the second control signal CTR2. In the case that the switch 402 is constructed with an NMOS transistor, the control signal CTR2 is turned on above a threshold voltage of the NMOS transistor to supply a power voltage VDD to a primary coil L3 of the transformer 404 through an input capacitor Cin2. Typically 12 volts are used as the power voltage VDD. A coil winding ratio between the primary coil L3 and a secondary coil L4 in the transformer is set to provide the cold cathode fluorescent lamp 110 with the driving power ranging from 600 volts to 800 volts. The driving power DRV1, which is caused at the second coil L4 and outputted through an output capacitor COUT2, has the same duty cycle as the frequency of the second control signal CTR2 since the driving power DRV2 is caused by fluctuations of the second control circuit CTR2.

Figure 5:
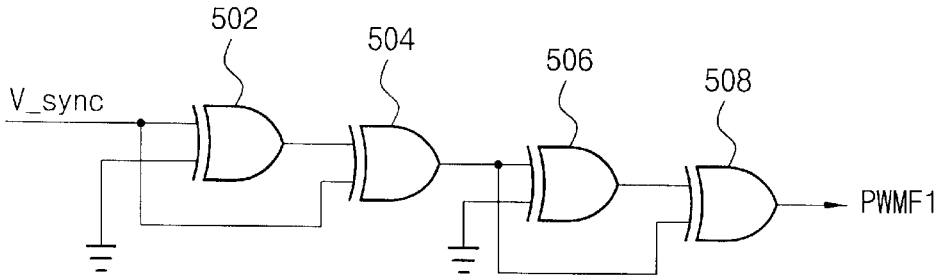
FIG. 5 is a circuit diagram of an example of the frequency multiplier shown in FIG. 2.

FIG. 5 is a circuit diagram of the frequency multiplier shown in FIG. 2. As shown in FIG. 5, the frequency multiplier for multiplying the frequency by 4 is constructed with four exclusive OR gates 502, 504, 506, 508. In FIG. 5, the vertical synchronization signal V_sync is provided to each input terminal for the exclusive OR gates 502, 504. The other input terminal for the exclusive OR gate 502 is grounded and the other input terminal for the exclusive OR gate is connected to the output terminal for the exclusive OR gate 502. The output terminal for the exclusive OR gate 504 is connected to each input terminals for the exclusive gates 506, 508. The other input terminal for the exclusive OR gate 506 is grounded and the other input terminal for the exclusive OR gate 508 is connected to the output terminal for the exclusive OR gate 506. The output terminal for the exclusive OR gate 508 corresponds to an output terminal for the frequency multiplier.

Figure 6:
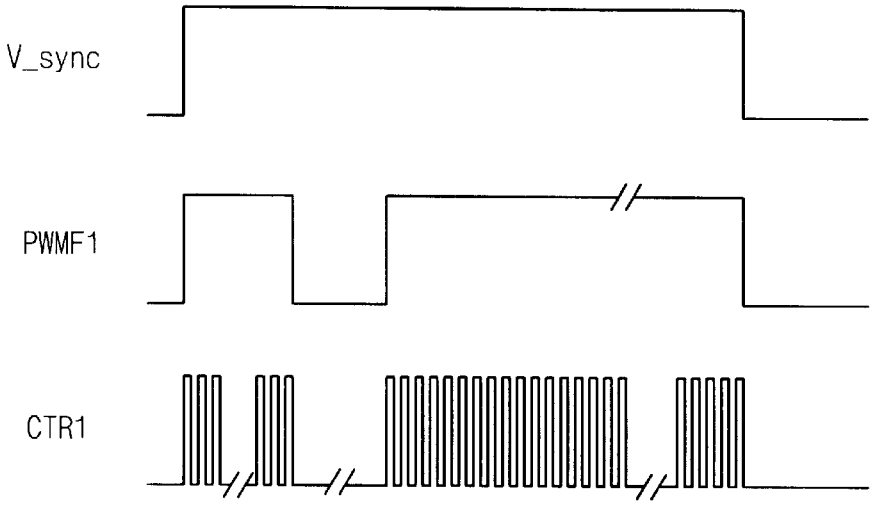
FIG. 6 is a view of a signal wave illustrating an operation of the present invention.
Figure 7:
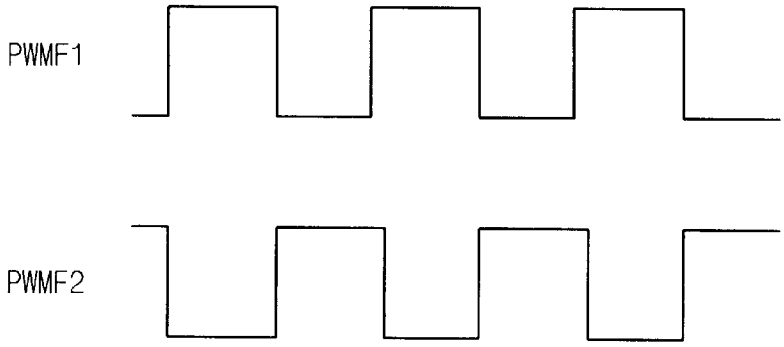
FIG. 7 is a view of a signal wave illustrating a signal delay relation.

FIG. 6 is a signal wave diagram illustrating the operation of the present invention. As shown in FIG. 6, the first pulse width modulation frequency signal PWMF1 and the first control signal are synchronized with the vertical synchronization signal V_sync. In other words, since the PWM frequency signal is generated at a start point of the vertical synchronization signal V_sync, the synchronization with the vertical synchronization signal V_sync is obtained. FIG. 7 is a signal wave diagram illustrating a delay relation between the first pulse width modulation frequency signal PWMF1 and the second pulse width modulation frequency signal PWMF2 in the present invention. As shown in FIG. 7, there exists a phase difference of about 180° between the first pulse width modulation frequency signal PWMF1 and the second pulse width modulation frequency signal PWMF2, in which noise and voltage fluctuation in the power voltage due to the turning on and turning off of the lamp can be very effectively reduced.

Figure 8:
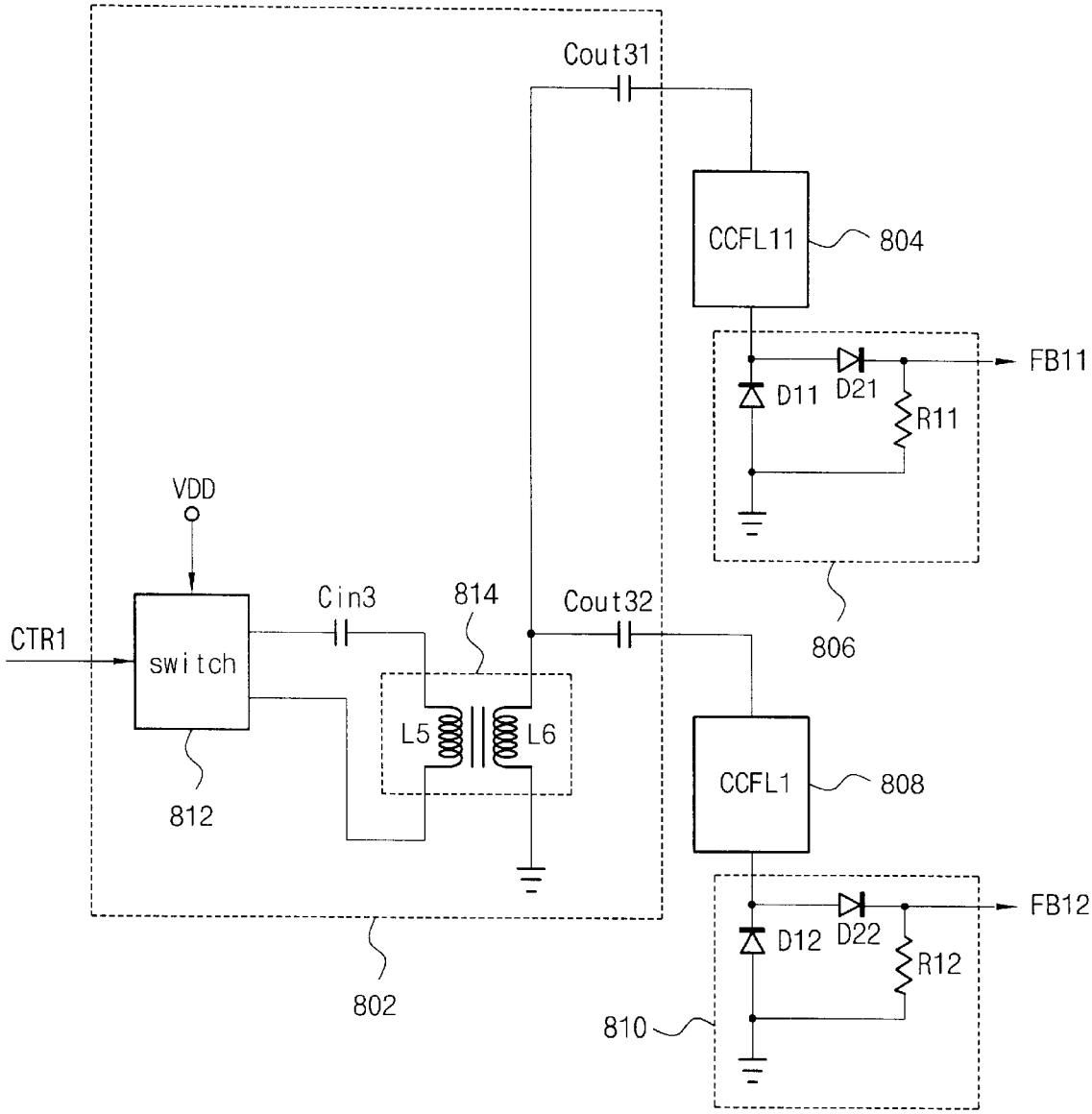
FIG. 8 is a structural diagram showing a connection between a power supply unit and a lamp according to another embodiment of the present invention.

FIG. 8 is a structural diagram illustrating the relation between a power supplier and a lamp in another embodiment of the present invention. In comparison with the first embodiment in FIG. 3, the second embodiment in FIG. 8 is distinguished from the first embodiment in that two lamps 804, 806 are connected to a single power supply unit 802 in parallel. The current measuring unit 806 measures current flowing in the lamp 804 to produce the feedback signal FB11, while the current measuring unit 810 measures current flowing in the lamp 808 in order to produce the feedback signal FB12. By providing both feedback signals FB11, FB12 or any one of two feedback signals to the control unit 102 (FIG. 1), the control signal CTR1 is controlled according to current flowing in the lamps 804, 808.

It is preferable that the CCFL inverter control unit of the present invention is embodied with a scaler on an A/D board and a single semiconductor chip. It is because the CCFL inverter control unit of the present invention needs a number of logic gates. By employing the single semiconductor chip, it is possible to save cost and reduce chip mounting space on a printed circuit board.

With the construction of the present invention, it is possible to reduce noise and voltage fluctuation in the power voltage due to turning on and turning off of the lamp and to eliminate a horizontal wave or a flicker due to interference between the PWM signal and the vertical synchronization signal. Further, the present invention has another advantage in that the lamp can be driven with a constant frequency even when the vertical synchronization signal varies.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A low noise backlight system for use in a display device, the system comprising:

a first and a second lamps;

a control unit for receiving a vertical synchronization signal of the display, producing a first control signal which has a duty cycle controlled depending upon current flowing in the first lamp and is synchronized with the vertical synchronization signal, and producing a second control signal which has a duty cycle controlled depending upon current flowing in the second lamp, is synchronized with the vertical synchronization signal and has a predetermined time lag with respect to the first control signal;

a first power supply unit for producing a first driving voltage for causing the first lamp to be driven in synchronization with the first control signal and supplying the first driving voltage to the first lamp; and, a second power supply unit for producing a second driving voltage for causing the second lamp to be driven in synchronization with the second control signal and supplying the second driving voltage to the second lamp.

2. The backlight system as claimed in claim 1, wherein the control unit comprises:

a first frequency multiplier for multiplying a frequency of the vertical synchronization signal by an integer to produce a first pulse width modulation frequency signal;

a signal delayer for delaying the first pulse width modulation frequency signal for a predetermined time to produce a second pulse width modulation frequency signal;

a first current measuring unit for measuring current flowing in the first lamp to produce a first feedback signal;

a second current measuring unit for measuring current flowing in the second lamp to produce a second feedback signal;

a first pulse width modulator for producing a first pulse width modulation signal which is synchronized with the first pulse width modulation frequency signal and has a duty cycle determined by the first feedback signal;

a second pulse width modulator for producing a second pulse width modulation signal which is synchronized with the second pulse width modulation frequency signal and has a duty cycle determined by the second feedback signal;

a first control signal generator for receiving the first pulse width modulation signal and measuring the frequency thereof, and producing the first control signal with a constant frequency obtained by an integer multiplication depending on the measured frequency; and a second control signal generator for receiving the second pulse width modulation signal and measuring the frequency thereof, and producing the second control signal with a constant frequency obtained by an integer multiplication depending on the measured frequency.

3. The backlight system as claimed in claim 2, wherein the first control signal generator comprises:

a first frequency detecting circuit for receiving the first pulse width modulation signal and measuring a frequency thereof; and, a first frequency multiplication circuit for producing the first control signal with a constant frequency obtained by multiplying the first pulse width modulation signal by an integer depending on the measured frequency of the first pulse width modulation signal.

4. The backlight system as claimed in claim 2, wherein the second control signal generator comprises:

a second frequency detecting circuit for receiving the second pulse width modulation signal and measuring a frequency thereof; and, a second frequency multiplication circuit for producing the second control signal with a constant frequency obtained by multiplying the second pulse width modulation signal by an integer depending on the measured frequency of the second pulse width modulation signal.

5. The backlight system as claimed in claim 2, wherein the control unit includes a scaler of the display device and a semiconductor chip.

6. The backlight system as claimed in claim 1, wherein the first and the second lamps are cold cathode fluorescent lamps.

7. The backlight system as claimed in claim 1, wherein the first power supply unit comprises:

a first switch which is turned on by the first control signal and outputs power voltages through its output terminal; and, a first transformer including a first coil connected to the output terminal of the first switch and a second coil connected to the first lamp.

8. The backlight system as claimed in claim 1, wherein the second power supply unit comprises:

a second switch which is turned on by the second control signal and outputs power voltages through its output terminal; and, a second transformer including a first coil connected to the output terminal of the second switch and a second coil connected to the first lamp.

9. A method for driving a backlight system including a first and a second lamps for use in a display device, the method comprising steps of:

receiving a vertical synchronization signal of the display device, producing a first control signal which has a duty cycle controlled depending upon currents flowing in the first lamp and is synchronized with the vertical synchronization signal, and producing a second control signal which has a duty cycle controlled depending upon currents flowing in the second lamp, is synchronized with the vertical synchronization signal and has a predetermined time lag with respect to the first control signal;

producing a first driving voltage for causing the first lamp to be driven in synchronization with the first control signal and supplying the first driving voltage to the first lamp; and, producing a second driving voltage for causing the second lamp to be driven in synchronization with the second control signal and supplying the second driving voltage to the second lamp.

10. The method as claimed in claim 9, wherein the step of producing the control signals comprises:

producing a first pulse width modulation frequency signal by multiplying a frequency of the vertical synchronization signal by an integer, and producing a second pulse width modulation frequency signal by delaying the first pulse width modulation frequency signal for a predetermined time;

producing a first feedback signal by measuring current flowing in the first lamp and producing a second feedback signal by measuring current flowing in the second lamp;

producing a first pulse width modulation signal which is synchronized with the first pulse width modulation frequency signal and has a duty cycle determined by the first feedback signal, and producing a second pulse width modulation signal which is synchronized with the second pulse width modulation frequency signal and has a duty cycle determined by the second feedback signal; and, receiving the first pulse width modulation signal to measure a frequency thereof and producing the first control signal with a constant frequency obtained by an integer multiplication depending upon the measured frequency, and receiving the second pulse width modulation signal to measure a frequency thereof and producing the second control signal with a constant frequency obtained by an integer multiplication depending upon the measured frequency.

* * * * *